United States Patent [19]

Klocker

[11] Patent Number: 4,478,256

[45] Date of Patent: Oct. 23, 1984

[54] APPARATUS FOR PRODUCING A SELVAGE PROVIDED WITH A CROSSWEAVE

[75] Inventor: Heinz Klocker, Borken, Fed. Rep. of Germany

[73] Assignee: Gebr. Klocker (Klocker Bros.), Fed. Rep. of Germany

[21] Appl. No.: 457,889

[22] Filed: Jan. 14, 1983

[51] Int. Cl.[3] ..... D03C 11/00; D03C 7/06

[52] U.S. Cl. ..... 139/54

[58] Field of Search ..... 139/54, 48, 430

[56] References Cited

U.S. PATENT DOCUMENTS

| | | | |
|---|---|---|---|
| 2,918,945 | 12/1959 | Hall | 139/54 |
| 3,171,443 | 3/1965 | Hall | 139/54 |
| 3,369,570 | 2/1968 | Lacy | 139/54 |

FOREIGN PATENT DOCUMENTS

| | | | |
|---|---|---|---|
| 2916838 | 11/1980 | Fed. Rep. of Germany | 139/54 |
| 2040321 | 8/1980 | United Kingdom | 139/54 |
| 2083085 | 3/1982 | United Kingdom | 139/54 |

*Primary Examiner*—James Kee Chi

*Attorney, Agent, or Firm*—Roberts, Spiecens & Cohen

[57] ABSTRACT

Apparatus for producing a selvage provided with a crossweave, comprising two reciprocally movable weaving shafts on one of which is a needle holder and on the other of which is a main rail with a diagonal slit. A header rail is movably supported adjacent the main rail for limited travel, the header rail having a diagonal slit which overlaps the diagonal slit in the main rail. The main rail is connected to the other weaving shaft by an elastic connection in the form of elastic bands or cords.

8 Claims, 4 Drawing Figures

APPARATUS FOR PRODUCING A SELVAGE PROVIDED WITH A CROSSWEAVE

FIELD OF THE INVENTION

The invention relates to apparatus for producing a selvage provided with a crossweave, particularly for shuttleless looms, comprising two reciprocally movably weaving shafts, a needle holder on one of the weaving shafts and a main rail with a diagonal slit on the other of the weaving shafts. A header rail is movably mounted on the main rail for limited travel, the header rail having a diagonal slit arranged crosswise in overlapped relation relative to the diagonal slit in the main rail and a connection device, such as, a strap joins the main rail and the weaving shaft.

PRIOR ART

In shuttleless looms the weft thread is threaded into the shed without a shuttle and, after having been threaded, is cut off at its ends. As a result, a selvage is created at the edge of the cloth which tends to fray easily.

To prevent the fraying of this selvage, it is conventional to provide the selvage with a crossweave by a device comprising a main rail and a header rail with respective diagonal slits overlapping one another, the rails being movable relative to each other such that the overlapped slits form a precisely defined opening one end of which opens at the header rail and the other end of which opens at the main rail and through which the weft threads are drawn. As a result of this arrangement, shortly after the beginning of reverse motion of the weaving shaft, the weft thread already is at the ends of the slits, which is necessary for correct travel of the weft thread from one side of the needle to the other.

For very high operating speeds, however, the connection device joining the main rail to the weaving shaft can rupture as a result of the substantial inertial forces.

SUMMARY OF THE INVENTION

An object of the invention is to provide a construction for a shuttleless loom which overcomes this disadvantage.

In accordance with the invention, this is achieved by making the connection means of an elastically resilient material such as a rubber band or a rubber cord.

As a consequence of this construction, at very high operating speeds the inertial forces are absorbed by the elastically resilient band, thus preventing rupture of the connection.

BRIEF DESCRIPTION OF THE VIEWS OF THE DRAWING

In the drawing is shown one embodiment of the invention in which.

DETAILED DESCRIPTION

Figure 1:
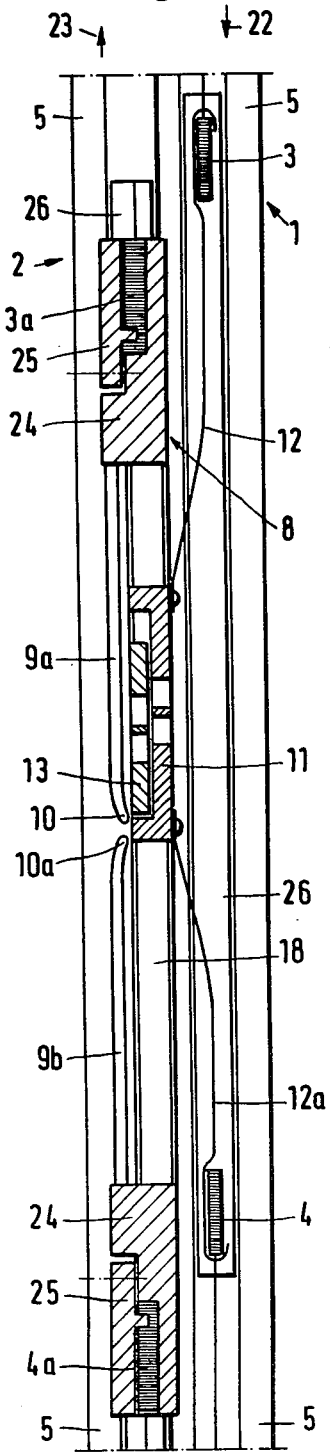
FIG. 1 is a cross-sectional view of the construction according to the invention.

In the drawing is shown a device for producing a selvage with a crossweave which comprises a first weaving shaft 1 and a second weaving shaft 2. Each weaving shaft includes two strand-bearing rails 3, 4 and 3*a*, 4*a* respectively which are connected to each other, for example, by means of a heald frame 26.

The guidance of each weaving shaft takes place in a guide frame 5, which is depicted only schematically.

Figure 4:
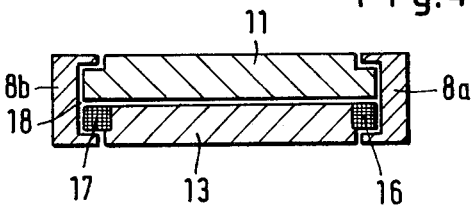
FIG. 4 is a cross-sectional view taken along line IV—IV in FIG. 2.

Attached to the weaving shaft 2, i.e., to the strand-bearing rails 3*a* and 4*a* respectively is a needle holder 8. The attachment is made, for example, by shims 24 and 25. The needle holder 8 comprises two carriage rails 8*a*, 8*b* of U-shape placed opposite each other such that they form a guide groove 18 (FIG. 4). The needles of the needle holder are indicated at 9*a*, and 9*b* respectively and are provided with respective eyes 10,10*a* through which the warp threads are drawn.

A header rail 13 is positioned in front of a main rail 11 and is capable of carrying out limited travel relative to the main rail. This limitation of travel is effected by stops 14 and 15, attached to the main rail 11. The header rail 13 carries magnets 16 and 17 on opposite sides thereof for reversing the relative movement of rail 13 as will be explained in greater detail later.

In place of the magnets for achieving reversing relative movement, springs can also be used to hold the header rail from the main rail under a given force.

Guidance of the main rail 11 and the header rail 13 is effected by the guide rails 8*a* and 8*b* which form the guide groove 18.

Both the main rail 11 as well as the header rail 13 are provided with respective diagonal slits 19, 20 which are arranged in overlapping arrangement. Thereby, a defined opening 21 is created at the intersection point of the slits. In the event that a plurality of weft threads are employed, a corresponding number of additional slits are provided.

The main rail 11 is connected to the strand-bearing rail 3 of the weaving shaft 1 by means of an elastic band 12 whereas main rail 11 is connected to the strand-bearing rail 4 of the weaving shaft 1 by elastic band 12*a*. The elastic bands can be made from rubber or similar material.

The elastic bands 12 and 12*a* assure that at the high operational speeds at which the weaving shafts are operated, a rupture of the bands will not take place as a result of the high inertial forces.

The operation of the device is as follows:

Assuming that the weaving shaft 1 with its strand-bearing rails 3 and 4 has reached its upper position and is beginning its reverse travel in the direction of the arrow 22, then the needle holder 8, which is attached to the weaving shaft 2, i.e. to the strand-bearing rails 3*a*, 3*b*, undergoes an upward travel in the direction of the arrow 23.

The main rail 11, which is connected to the weaving shaft 1 by elastic bands 12, 12*a*, undergoes downward travel. This downward travel, however, is not carried out by the header rail 13, since it is magnetically connected to the needle holder, i.e. to the carriage rails 8*a*, 8*b*. The header rail 13 consequently undergoes an upwardly directed motion relative to the main rail, i.e. in the direction of the arrow 23, until it strikes the stop 15.

Figure 2:
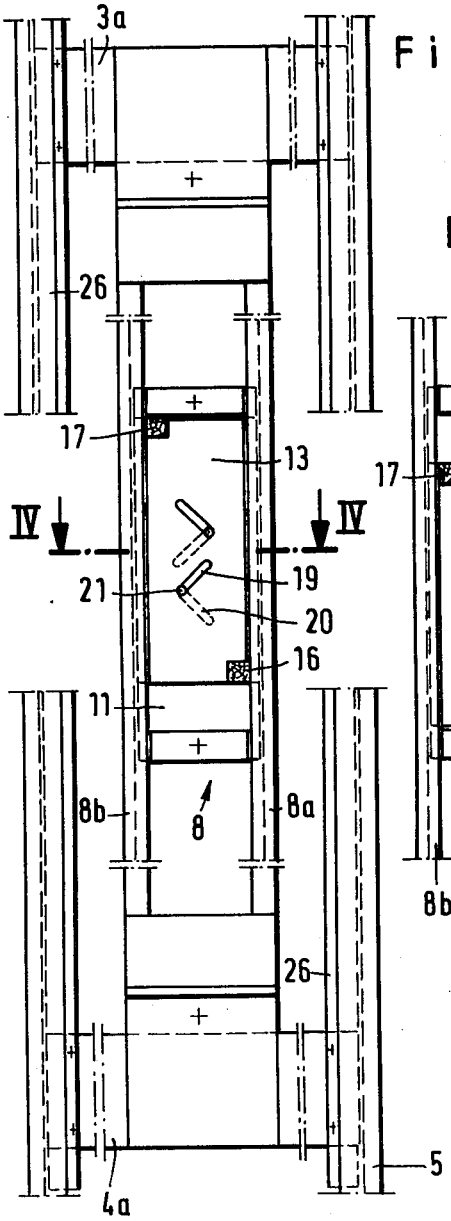
FIG. 2 is a front view of a needle holder together with the main rail wherein the needle has been omitted for the sake of clarity.
Figure 3:
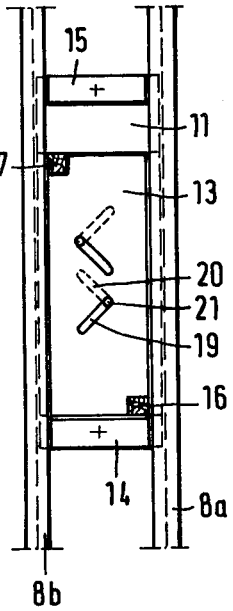
FIG. 3 shows a portion of FIG. 2 with the header rail in a different position in relation to the main rail.

By means of this relative motion of the header rail 13 with respect to the main rail 11, the position of the opening 21 formed by the diagonal slits 19 and 20 is changed accordingly, namely from their position in FIG. 3 to the position shown in FIG. 2. The weft thread drawn through the opening 21 consequently undergoes a horizontal motion and adjoins the needles 9*a*, 9*b* with a certain degree of tension.

Upon return travel of the weaving shaft 1, the weft thread reaches the area of the end of the needle, i.e., the area between the eyes 10, 10*a*, where the needles are spaced at a certain distance from each other, and the weft thread will pass through the needle spacing to extend to the other side of the needle whereby the weft thread is in the necessary position for proper weave. The warp threads being drawn through the eyes 10, 10*a* always undergo a precise vertical movement. By the horizontal motion of the weft threads and the vertical motion of the warp threads, weaving is effected.

As evident from the drawing, the elastic bands 12 and 12*a* extend in opposite directions from opposite ends of the main rail 11 to the weaving shaft 1 whereby to hold the main rail 11 in elasticially suspended relation relative to the weaving shaft 1. As a consequence of the elasticity of the band members, the main rail is resiliently supported and at high operation speeds at which the weaving shafts are operated, the band members will yield and will not undergo rupture.

Although the invention has been described in connection with a specific embodiment thereof, it will become apparent to those skilled in the art that numerous modifications and variations can be made within the scope and spirit of the invention as defined in the attached claims.

What is claimed is:

1. Apparatus for producing a selvage provided with a crossweave, comprising two reciprocally movable weaving shafts, a needle holder on one of said weaving shafts, a main rail with a diagonal slit on the other of said weaving shafts, a header rail movably supported adjacent the main rail for limited travel, said header rail having a diagonal slit which overlaps the diagonal slit in the main rail and elastic connection means joining the main rail to said other weaving shaft for providing normal conjoint travel thereof and being flexible to prevent rupture of said connection means due to high inertial forces at high speeds of travel of said main rail and said weaving shafts.

2. Apparatus as claimed in claim 1 wherein said elastic connection means comprises elastic band members.

3. Apparatus as claimed in claim 2 wherein said band members are flexible and resilient.

4. Apparatus as claimed in claim 3 wherein said band members are made from rubber.

5. Apparatus as claimed in claim 1 wherein said other weaving shaft includes strand-bearing rails for supply of weft thread to said slits.

6. Apparatus as claimed in claim 1 wherein said elastic connection means comprises elastic band members extending in opposite directions from opposite ends of said main rail to said other weaving shaft whereby to hold said main rail in elastically suspended relation relative to said other weaving shaft.

7. Apparatus as claimed in claim 6 wherein said needle holder includes means slidably supporting said main rail.

8. Apparatus as claimed in claim 1 wherein said elastic connection means comprises band members made of elastically, yieldable material.

* * * * *